US006109221A

United States Patent [19]

Higgins et al.

[11] Patent Number: 6,109,221

[45] Date of Patent: Aug. 29, 2000

[54] ENGINE WITH INTEGRAL COOLANT PUMP

[75] Inventors: Timothy E. Higgins, Kohler; Gregory E. Schmitz, Sherwood; Terrence M. Rotter, Sheboygan Falls; Anthony L. Coffey, Grafton, all of Wis.

[73] Assignee: Kohler Co., Kohler, Wis.

[21] Appl. No.: 09/250,856

[22] Filed: Feb. 17, 1999

[51] Int. Cl.[7] ..... F01P 5/10

[52] U.S. Cl. ..... 123/41.47; 123/198 C

[58] Field of Search ..... 123/41.44, 41.45, 123/41.47, 195 R, 195 A, 198 C, 54.4, 90.22, 90.31

[56] References Cited

U.S. PATENT DOCUMENTS

| | | | |
|---|---|---|---|
| 1,519,155 | 12/1924 | Moorhouse . | |
| 1,658,773 | 2/1928 | Taub . | |
| 1,873,146 | 8/1932 | Patch . | |
| 1,954,090 | 4/1934 | Moorhouse | 123/175 |
| 2,068,536 | 1/1937 | Davies | 103/175 |
| 2,186,080 | 1/1940 | Sheldrick | 123/175 |
| 3,603,296 | 9/1971 | Mitchell | 123/41.47 |
| 3,730,147 | 5/1973 | Buchwald | 123/41.44 |
| 4,155,333 | 5/1979 | Maggiorana | 123/41.44 |
| 4,412,513 | 11/1983 | Obermayer et al. | 123/54.4 |
| 4,448,159 | 5/1984 | Hidaka et al. | 123/41.44 |
| 4,756,280 | 7/1988 | Tamba et al. | 123/41.47 |
| 4,873,945 | 10/1989 | Tamba et al. | 123/54.4 |
| 5,191,859 | 3/1993 | Fujiwara | 123/41.44 |
| 5,279,265 | 1/1994 | Matsuo et al. | 123/41.44 |

FOREIGN PATENT DOCUMENTS

| | | | |
|---|---|---|---|
| 6-42348 | 2/1994 | Japan | 123/41.44 |

*Primary Examiner*—Noah P. Kamen
*Attorney, Agent, or Firm*—Quarles & Brady LLP

[57] ABSTRACT

A V-type engine having a crankcase with a face, and cylinders arranged so as to form a V space therebetween. Pistons slidably mounted in the cylinders rotatably drive a crankshaft. The crankshaft is rotatably mounted in the crankcase at the junction of the V and has one end extending through the crankcase face. A timing gear engaged by the crankshaft rotatably drives a camshaft rotatably mounted in the crankcase. The camshaft extends through the crankcase face and has a sprocket mounted thereon which engages a drive belt. The drive belt rotatably drives a coolant pump interposed between the crankcase face and flywheel. The coolant pump has a pump cavity which is formed as an integral part of the crankcase face, and an impeller shaft with a rotational axis arranged substantially parallel to the crankshaft outside of the V space. A flywheel is mounted on the crankshaft end extending through the crankcase face and substantially covers the face and coolant pump.

8 Claims, 3 Drawing Sheets

ENGINE WITH INTEGRAL COOLANT PUMP

FIELD OF THE INVENTION

The field of the invention relates to internal combustion engines, more particularly to a V-type internal combustion engines with an integral coolant pump.

DESCRIPTION OF THE BACKGROUND ART

Small internal combustion V-type engines having two to four cylinders are commonly used in non-automotive commercial applications, such as lawn mowers, construction equipment, generator sets, off-road vehicles or the like. The small size of these engines relative to their power output is a desirable feature, and efforts continue to provide an increasingly more compact engine. Because of the small number of cylinders in comparison to larger engines, such as automotive engines having four cylinders or more, providing an increasingly compact engine becomes more difficult due to the lack of options for mounting engine components, such as a coolant pump, fuel pump, carburetor, control system, and the like, to the engine crankcase.

A typical small V-type internal combustion engine, suitable for industrial or commercial use, has a crankcase with cylinders formed therein. The cylinders are arranged to form a V and receive reciprocating pistons which rotatably drive the crankshaft. In an effort to provide compact engines, prior art engines position various engine components, such as a coolant pump, fuel pump, carburetor, control system, and the like in a V space defined by the engine cylinders. Although positioning these components within the V-space reduces the engine size, it complicates the engine design and makes servicing these components difficult because of the space limitations.

One particular prior art vertical shaft V-type engine disclosed in U.S. Pat. No. 4,756,280 has a coolant pump disposed in the V-space on a bottom face of the crankcase. As discussed above, locating the coolant pump within the V-space complicates the engine. Furthermore, mounting the pump on the bottom face of the crankcase does not enhance the engine compactness, but does make servicing the pump more difficult.

In a non-analogous six cylinder horizontal V-type engine disclosed in U.S. Pat. No. 5,279,265, the coolant pump is disposed outside of the V-space, however a coolant distribution chamber receiving the coolant discharged by the pump is disposed in the V-space defeating the purpose of removing the pump from the V-space to provide a compact engine. This particular engine also has a complicated chain drive wherein the engine timing chain also rotatably drives the coolant pump and renders pump maintenance difficult.

SUMMARY OF THE INVENTION

The present invention provides a V-type engine having a crankcase with top face, bottom face, and cylinders formed therein between the top and bottom faces. The cylinders are arranged so as to form a V space therebetween. Pistons slidably mounted in the cylinders rotatably drive a crankshaft which is rotatably mounted in the crankcase at the junction of the V. The crankshaft internally engages a timing gear which rotatably drives a camshaft. The camshaft is substantially parallel to the crankshaft and is rotatably mounted in the crankcase. The camshaft extends through the crankcase top face and has a sprocket mounted thereon which engages a drive belt. The drive belt rotatably drives a coolant pump interposed between the crankcase face and flywheel. The coolant pump has an impeller shaft with one end enclosed in a pump cavity formed as an integral part of the crankcase top face. The impeller shaft has a rotational axis arranged substantially parallel to the crankshaft and outside of the V space. A flywheel mounted on the crankshaft end extending through the crankcase top face substantially covers the crankcase face and coolant pump.

A general objective of the present invention is to provide a compact V-type engine suitable for non-automotive commercial use which is easy to maintain. This objective is accomplished by forming the pump cavity as an integral part of the crankcase face substantially out of the V-space and interposed between the crankcase face and the flywheel. This arrangement provides easy access to the pump and does not complicate the space defined by the cylinders.

Another objective of the present invention is to provide a vertical shaft V-type engine suitable for non-automotive commercial use which has an easily serviceable coolant pump. This objective is accomplished by providing a coolant pump with a pump shaft disposed outside of the V-space which is rotatably driven by a belt engaging the cam shaft.

The foregoing and other objects and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

FIG. 2.

DETAILED DESCRIPTION OF THE PREFERRED EMBODIMENTS

Figure 1:
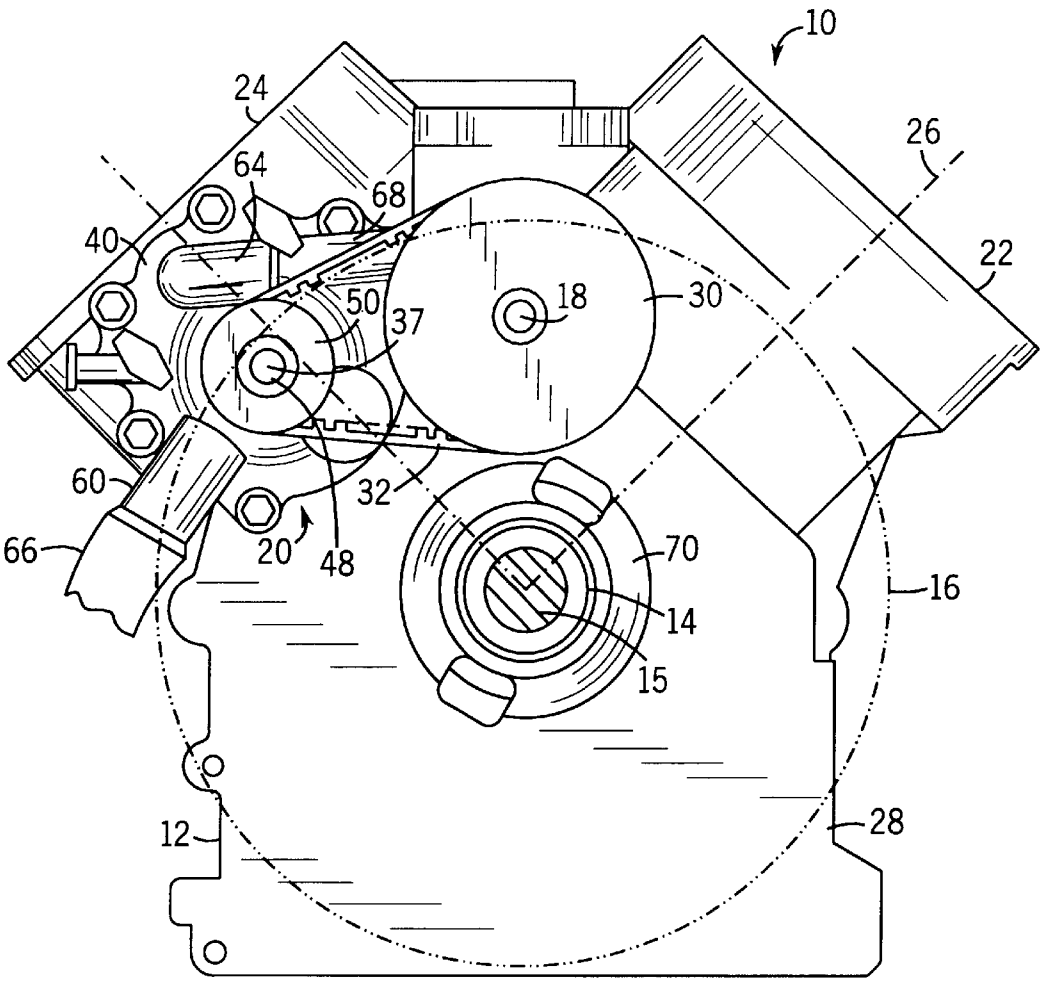
FIG. 1 is a top plan view of a vertical shaft V-type internal combustion engine incorporating the present invention.
Figure 2:
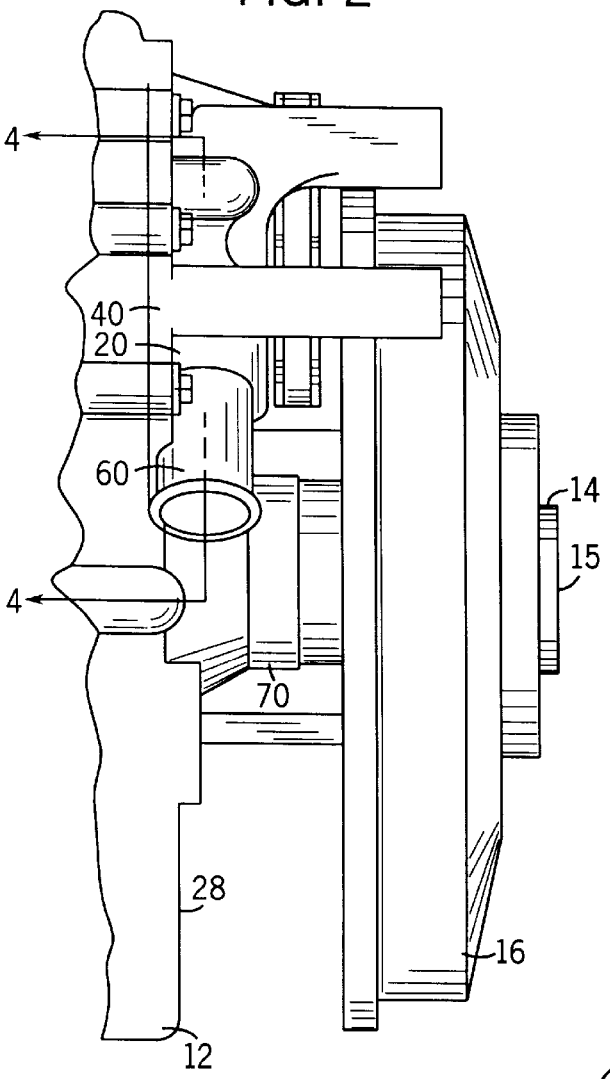
FIG. 2 is a partial elevational side view of the engine of FIG. 1.

Referring to FIGS. 1 and 2, a vertical shaft V-type internal combustion engine 10 includes a crankcase 12 with a top face 28, bottom face (not shown) and two cylinders 22, 24 formed therein defining a V 26 (shown by dashed lines). Pistons (not shown) received in the cylinders 22, 24 rotatably drive a crankshaft 14 having an end 15 extending through the crankcase top face 28 at the V 26 junction. A coolant pump 20 formed as an integral part of the crankcase top face 28 forces coolant through an engine cooling system during engine 10 operation. The cooling pump 20 has an impeller shaft 48 with a rotational axis 37 outside of the space defined by the V 26, and substantially covered by a flywheel 16 mounted on the crankshaft end 15.

The crankcase 12 is cast aluminum and has two cylinders 22, 24 formed therein. The cylinders 22, 24 are arranged with one cylinder 22 vertically offset from the other cylinder 24, and to form a V 26. Each cylinder 22, 24 receives a reciprocating piston which rotatably drives the vertical crankshaft 14 and has a head (not shown) which encloses the piston therein. Coolant is circulated through water jackets 34 formed in the crankcase 12 and cylinder heads to cool the cylinders 22, 24 during engine 10 operation. Although a compact two cylinder engine is described herein, the engine may have four or fewer cylinders without departing from the scope of the present invention.

The crankshaft 14 is rotatably mounted in the crankcase 12 at the V 26 junction. One end of the crankshaft 14 supports the flywheel 16 disposed above the crankcase top face 28 and the other crankshaft end (not shown) extends out of an oil pan (not shown) mounted to the crankcase bottom (not shown) to rotatably drive an apparatus, such as a lawn tractor or the like. A timing gear (not shown) engages the crankshaft 14 and rotatably drives the camshaft 18. The rotatably mounted camshaft 18 is disposed in the V space defined by the V 26 and controls valves which allow gases to enter or exit the cylinders 22, 24 during engine 10 operation. One end of the camshaft 18 extends past the crankcase top face 28 and has a sprocket 30 mounted thereon. The camshaft sprocket 30 engages a toothed drive belt 32 which rotatably drives the coolant pump 20.

The internal combustion engine 10 is liquid cooled by forcing a coolant, such as water/ethylene glycol or the like, through a cooling system which includes the coolant pump 20 and water jackets 34. Operation of the internal combustion engine 10 generates heat in the cylinders 22, 24. The coolant flows through the water jackets 34 and absorbs the heat generated by the engine 10. The coolant is cooled as it passes through a radiator (not shown) and then returned to the water jackets 34 to absorb more heat from the engine 10.

Figure 3:
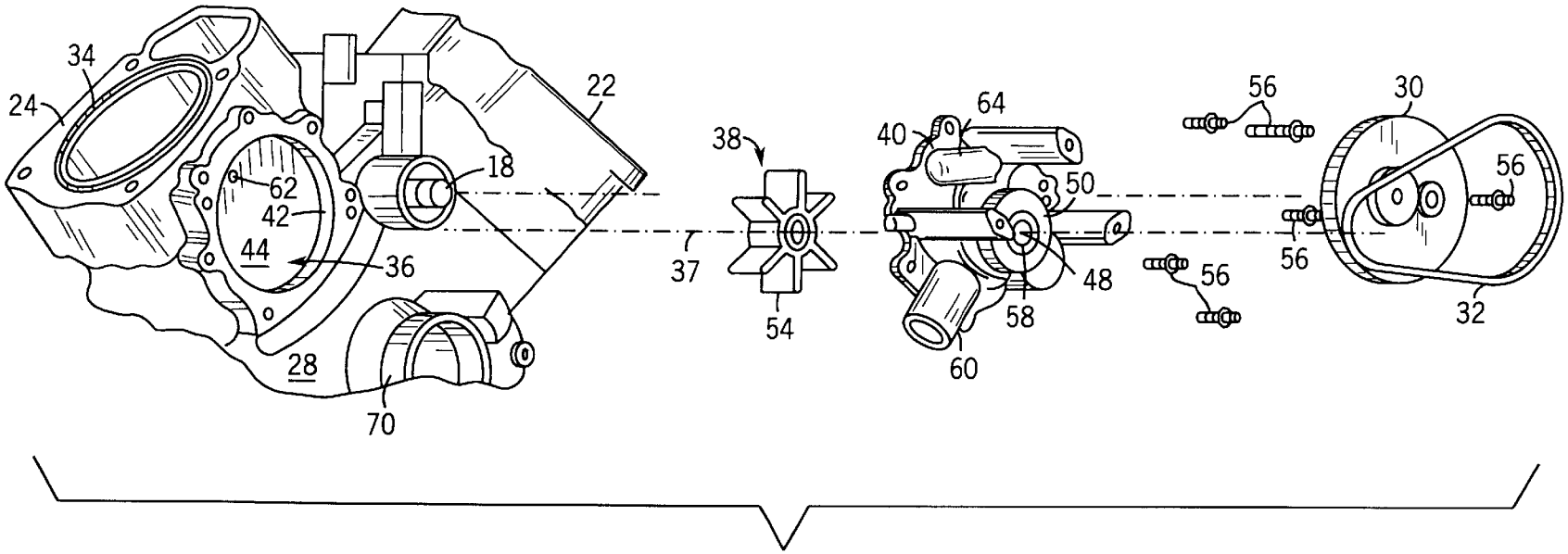
FIG. 3 is a partial exploded perspective view of the engine of FIG. 1.

Looking particularly at FIGS. 2 and 3, the coolant is forced through the cooling system by the coolant pump 20. The coolant pump 20 is interposed between the crankcase top face 28 and flywheel 16, and includes a pump chamber 36 formed as an integral part of the crankcase top face 28, an impeller 38 rotatably mounted in the pump chamber 36, and a pump cover 40 enclosing the impeller 38 inside the pump chamber 36. Advantageously, positioning the pump 20 between the crankcase 12 and flywheel 16 increases the engine 10 height less than the height of the pump 20 because of the existing space between the crankcase 12 and flywheel 16. In addition, locating the pump 20 on the crankcase top face 28 provides easy access to the pump components to simplify pump maintenance or repair. Preferably, the pump 20 is disposed on a portion of the crankcase top face 28 defined by the cylinder 24 which is vertically offset furthest away from the flywheel 16 to take advantage of the cylinder offset and further minimize the engine 10 height.

Cooled coolant is channeled into the pump chamber 36, pressurized, and then forced through the cooling system. As shown in FIG. 3, the pump chamber 36 is a circular cavity having a perimeter wall 42 which is formed as an integral part of the crankcase top face 28 and defines a generally circular cavity bottom 44. Forming the chamber as an integral part of the crankcase top face reduces the number of engine parts. An outlet port 62 formed in the cavity bottom proximal the chamber perimeter wall feeds pressurized coolant to the offset cylinder 24 water jacket 34.

Figure 4:
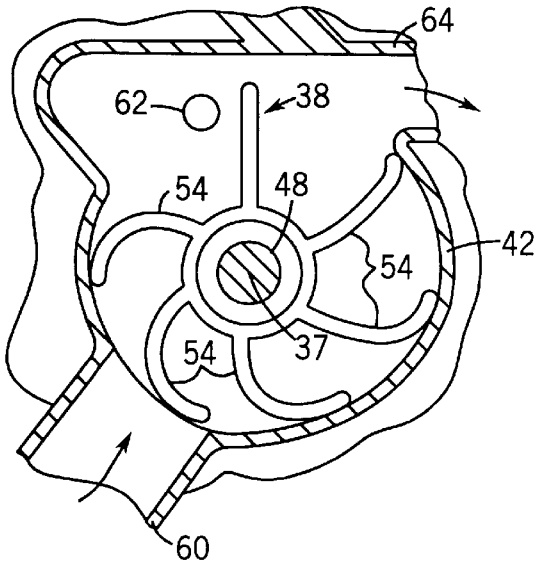
FIG. 4 is a sectional view along line 4—4 of the pump in FIG.

The impeller 38 is rotatably driven about the pump axis 37 by the drive belt 32 and increases the coolant pressure in the pump chamber 36. The impeller 38 is mounted on an impeller shaft 48 which defines the central pump axis 37 disposed outside of the space defined by the V 26. One end of the impeller shaft 48 extends through the pump cover 40 and has a sprocket 50 mounted thereon. The impeller sprocket 50 engages the drive belt 32 engaged by the camshaft sprocket 30 to rotatably drive the impeller shaft 48. The opposing impeller shaft 48 end is disposed inside the pump chamber 36 and has the impeller 38 mounted thereon. As shown in FIG. 4, rotation of the impeller shaft 48 causes the impeller blades 54 to compress the coolant inside the chamber 36 and force it out of the chamber through the outlet port 62 and an outlet nipple 64.

The pump cover 40 is mounted over the pump chamber 36 to enclose the impeller blades 54 in the pump chamber 36. Preferably, the pump cover 40 is die cast aluminum and mounted to the crankcase 12 using methods known in the art, such as screws 56. A gasket (not shown) interposed between the cover 40 and pump chamber 36 seals the chamber 36 to prevent leaks. The impeller shaft 48 extends through an opening 58 formed in the cover 40 which has bearings (not shown) mounted therein to reduce friction acting on the rotating impeller shaft 48, and support the drive belt 32 load. Cooling system coolant is drawn into the chamber 36 through an inlet 60 formed in the cover 40. The outlet nipple 64 is formed as part of the pump cover 40 proximal the chamber perimeter wall 42 and feeds pressurized coolant to the non-offset cylinder 22 water jacket 34. By providing an outlet port 62 formed in the pump chamber bottom 44 and an outlet nipple 64 in the cover 40, coolant is fed to both cylinders 22, 24 in parallel. The engine cooling system could also be constructed to feed the cylinders 22, 24 in series without departing from the scope of the present invention by closing the outlet nipple 64 and communicatively connecting the water jacket 34 surrounding the offset cylinder 24 to the non-offset cylinder 22 water jacket 34, such as by way of an intake manifold (not shown).

Referring back to FIG. 1, hoses 66, 68, capable of transporting pressurized coolant at typical engine coolant temperatures, channel the coolant into and out of the cooling pump 20. An inlet hose 66 communicatively connected to the pump inlet 60 channels the coolant in the cooling system into the pump chamber 36. An outlet hose 68 communicatively connected to the outlet nipple 64 receives the pressurized coolant and channels it to the non-offset cylinder 22 water jacket 34 for engine cooling. Preferably, the hoses 66, 68 are formed from materials known in the art for heated coolant under pressure, such as steel, rubber, or the like.

As shown in FIG. 1, the disc-shaped flywheel 16 is mounted to the crankshaft 14 end extending through the crankcase top face 28 and minimizes rotational speed fluctuations due to changes in a load on the engine 10. The flywheel 16 is disposed above and substantially covers the crankcase top face 28 and coolant pump 20. Referring to FIG. 2, preferably, a spacer 70 surrounding the crank shaft 14 and formed as an integral part of the crankcase top face 28 is interposed between the flywheel 16 and crankcase 12 to offset the flywheel 16 away from the crankcase top face 28 and prevent flywheel 16 interference with the coolant pump 20. Although the spacer 70 is preferably formed as an integral part of the crankcase top face 28 or flywheel 16, the spacer 70 may be a separate part mounted to the crankcase top face 28 or flywheel 16 without departing from the scope of the present invention. Most preferably, the spacer is a main bearing tower formed part of the engine crankcase housing a crankshaft main bearing.

While there has been shown and described what are at present considered the preferred embodiment of the invention, it will be obvious to those skilled in the art that various changes and modifications can be made therein without departing from the scope of the invention.

We claim:

1. An internal combustion engine, suitable for non-automotive commercial use, comprising:

a crankcase with cylinders arranged so as to form a V space therebetween, and a face;

a crankshaft rotatably mounted in said crankcase at the junction of the V and having an end extending through said face; and a coolant pump having a pump cavity formed as an integral part of the crankcase face, and an impeller shaft with a rotational axis arranged substantially parallel to said crankshaft outside of said V space;

a flywheel mounted to said crankshaft end extending through said face; and a spacer interposed between said face and said flywheel; wherein said flywheel is disposed away from said face providing clearance for said coolant pump.

2. The internal combustion engine as in claim 1 further comprising;

a camshaft rotatably mounted in said crankcase and extending through said face in the V space, said camshaft arranged substantially parallel to said impeller shaft; and a belt engaging said camshaft and said pump shaft, wherein said camshaft rotatably drives said impeller shaft.

3. The internal combustion engine as in claim 1, wherein said crankcase has four or fewer cylinders formed therein.

4. A vertical shaft V-type engine, suitable for non-automotive commercial use, comprising:

a crankcase with cylinders arranged horizontally so as to form a V space therebetween, and a top face;

a crankshaft rotatably mounted in said crankcase at the junction of the V and having an end extending through said top face;

a coolant pump having a pump cavity formed as an integral part of the crankcase top face, and an impeller shaft with a rotational axis arranged substantially parallel to said crankshaft outside of said V space;

a camshaft rotatably mounted in said crankcase and extending through said top face in the V space, said camshaft arranged substantially parallel to said pump shaft;

a belt engaging said camshaft and said impeller shaft, wherein said camshaft rotatably drives said pump shaft.

5. The vertical shaft V-type engine as in claim 4, further comprising:

a flywheel mounted to said crankshaft end extending through said top face;

a spacer interposed between said top face and said flywheel, wherein said flywheel is disposed away from said top face providing clearance for said coolant pump.

6. The internal combustion engine as in claim 4, wherein said crankcase has four or fewer cylinders formed therein.

7. The vertical shaft V-type engine, suitable for non-automotive commercial use, comprising:

a crankcase with cylinders arranged horizontally so as to form a V space therebetween, and a top face;

a crankshaft rotatably mounted in said crankcase at the junction of the V and having an end extending through said top face;

a coolant pump having a pump cavity formed as an integral part of the crankcase top face, and an impeller shaft with a rotational axis arranged substantially parallel to said crankshaft;

a camshaft rotatably mounted in said crankcase and extending through said top face in the V space, said camshaft arranged substantially parallel to said pump shaft;

a belt engaging said camshaft and said impeller shaft, wherein said camshaft rotatably drives said pump shaft;

a flywheel mounted to said crankshaft end extending through said top face; and a spacer interposed between said top face and said flywheel, wherein said flywheel is disposed away from said top face providing clearance for said coolant pump.

8. The internal combustion engine as in claim 7, wherein said crankcase has four or fewer cylinders formed therein.

* * * * *